US008869835B1

(12) United States Patent
Sapp et al.

(10) Patent No.: US 8,869,835 B1
(45) Date of Patent: Oct. 28, 2014

(54) DUAL VALVE

(71) Applicants: Stephen Sapp, Chattanooga, TN (US); Timothy Frost, Chattanooga, TN (US)

(72) Inventors: Stephen Sapp, Chattanooga, TN (US); Timothy Frost, Chattanooga, TN (US)

(73) Assignee: Burner Systems International, Inc., Chattanooga, TN (US)

( * ) Notice: Subject to any disclaimer, the term of this patent is extended or adjusted under 35 U.S.C. 154(b) by 0 days.

(21) Appl. No.: 13/864,731

(22) Filed: Apr. 17, 2013

Related U.S. Application Data

(60) Provisional application No. 61/625,406, filed on Apr. 17, 2012.

(51) Int. Cl.
*F16K 5/00* (2006.01)
*F16K 31/53* (2006.01)
*F23K 5/00* (2006.01)

(52) U.S. Cl.
CPC ..... *F23K 5/007* (2013.01)
USPC ..... 137/637; 137/883; 137/865; 251/249

(58) Field of Classification Search
USPC ..... 137/637, 637.2, 637.3, 613, 865, 883, 137/887; 431/281, 279, 278, 284; 251/248, 251/249
See application file for complete search history.

(56) References Cited

U.S. PATENT DOCUMENTS

| | | | | | |
|---|---|---|---|---|---|
| 1,379,025 | A * | 5/1921 | Jones et al. | ..... | 137/637 |
| 1,961,083 | A * | 5/1934 | Sherman et al. | ..... | 431/281 |
| 3,572,656 | A * | 3/1971 | Oshima | ..... | 137/637 |
| 4,749,004 | A * | 6/1988 | Peash | ..... | 137/887 |
| 4,921,598 | A * | 5/1990 | Desch | ..... | 137/637.3 |
| 5,035,262 | A * | 7/1991 | Schweikert | ..... | 137/637 |
| 7,494,337 | B2 * | 2/2009 | Specht et al. | ..... | 431/278 |
| 8,561,645 | B2 * | 10/2013 | Leroux et al. | ..... | 137/637.1 |

* cited by examiner

*Primary Examiner* — Kevin Lee
(74) *Attorney, Agent, or Firm* — Stephen J. Stark; Miller & Martin PLLC

(57) ABSTRACT

A dual valve construction partners first and second valve portions with a mechanical linkage such as gears to operably couple the control stems together. The gears need not be identical and in fact a first gear may have flats so that motion of the first gear need not always move the second gear proportionally. Furthermore, the gears may have differing gear ratios at different portion of the gears.

20 Claims, 3 Drawing Sheets

DUAL VALVE

CLAIM OF PRIORITY

This application claims the benefit of U.S. Provisional Patent Application No. 61/625,406 filed Apr. 17, 2012 which is incorporated in its entirety by reference.

FIELD OF THE INVENTION

The present invention relates to a dual valve constructed from operably coupled single valves.

DESCRIPTION OF RELATED ART

Gas component suppliers such as BSI have invested many millions of dollars over the years for manufacturing and assembly equipment to produce top burner gas valves for gas cooking appliances similar to what is shown in FIGS. 1 and 2. This type of valve is used to control and meter the amount of gas delivered to a single burner. The annual global production of these types of valves is in excess of 40 million. Obviously, with this type of annual volume vendors such as BSI have invested money to optimize production efficiencies and reduce costs. Some of the design features of this type of valve shown in the figures include: (1) a single control stem, (2) a single face plate, (3) a single gas inlet, and (4) a single gas outlet.

In recent years, some cooking benefits have been recognized through the development of gas burners that have two rings of flame. The gas flow to these two rings of flame must be controlled and operate normally under different parameters. This could be accomplished using two of the single valves described above. However, this configuration would require the operator to manipulate the two valves independently which might be cumbersome or lead to confusion.

Manufacturers such as BSI have developed dual outlet valves with a single control mechanism to satisfy this new demand for dual burners. This type of valve is shown in FIGS. 3 and 4. Unfortunately, the production of this type of valve requires a significant investment in manufacturing equipment since this type of valve cannot normally be produced on the same equipment as the single valves that have been produced for years. The sales volume for these dual outlet valves is very low (around 1 million) compared to the sales volume of the traditional single outlet valves. This low volume means that the production efficiencies achieved for the single valve are generally not normally achievable for the dual outlet valve. Note the design features of the dual outlet valve shown in the figure: (11) single control stem, (12) single face plate, (13) single gas inlet, and (14) dual gas outlets.

As one can see, there is a need to efficiently provide improved dual outlet valves in spite of the lack of volume as compared to traditional single outlet valves.

There is another need to attempt to increase the production efficiencies for dual outlet valves towards those efficiencies achievable for single outlet valves.

SUMMARY OF THE INVENTION

Accordingly, in accordance with a presently preferred embodiment of the present invention, it is an object of the present invention to provide an improved dual valve construction.

It is another object of many embodiments of the present invention to provide a dual valve construction which takes advantage of production efficiencies achieved with single valve constructions.

It is another object of many embodiments of the present invention to provide an improved valve which mechanically connects two single valves together.

Accordingly, and in accordance with a presently preferred embodiment of the present invention, a dual valve construction takes advantage of single valve technology. Specifically, two single valves are mechanically linked together wherein rotation of a control stem of one valve linkedly or rotates the valve stem of another single valve at desired times and amounts. Furthermore, a single face plate may be utilized for both valves. While there are two gas inlets, they can be joined to a common source. The two gas outlets can have the desired performance of dual gas outlet valves currently on the market. The performance characteristics can be selected by the manufacturer.

Accordingly, many of the embodiments of the present invention can utilize single valves mechanically connected together with their control stems mechanically coupled together. The valve body of high volume single valve constructions can then be employed. Two of the single gas valves can be joined together with a new face plate to join the design. Furthermore, by gearing the control stems together, they can be operated simultaneously by twisting one of the control stems which is linkedly connected or operably coupled to the other control stem. Accordingly, the second control stem can be rotated following the rotation of the first control stem as the first control stem is rotated by the user. The inlet(s) can be connected to an appropriate gas supply source and the two outlets can be directed to the appropriate burner locations.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
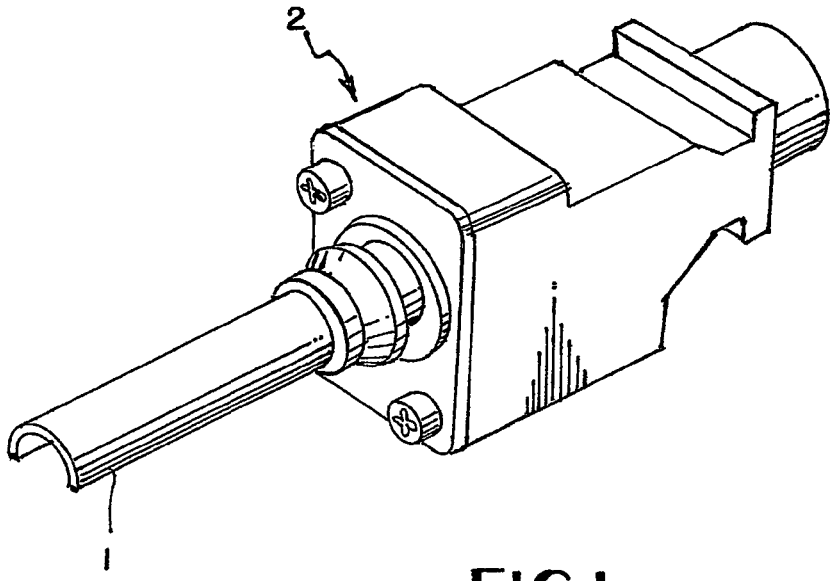
FIG. 1 PRIOR ART
FIG. 1 is a top perspective view of the prior art single gas valve construction.
Figure 2:
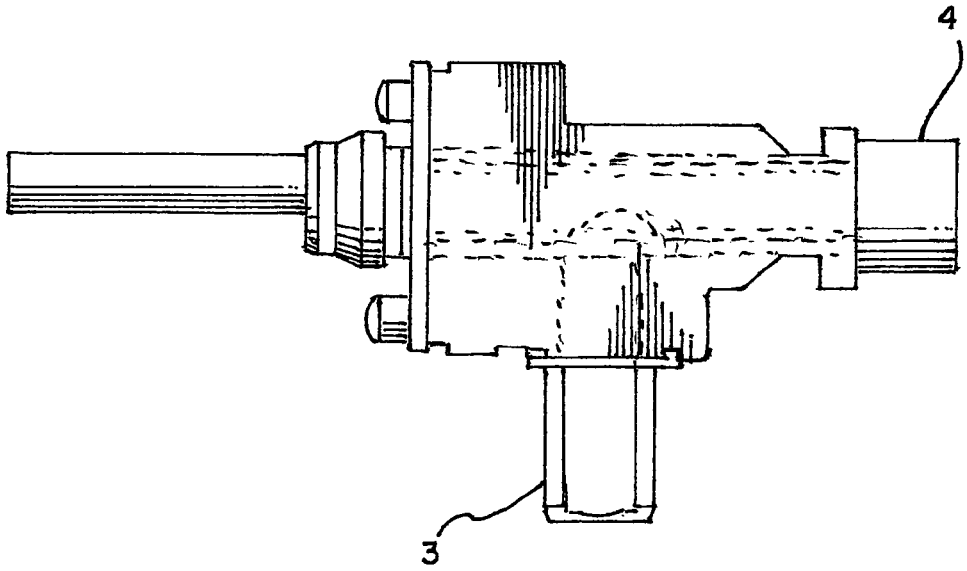
FIG. 2 PRIOR ART
FIG. 2 is a plan view of the single valve construction of FIG. 1.
Figure 3:
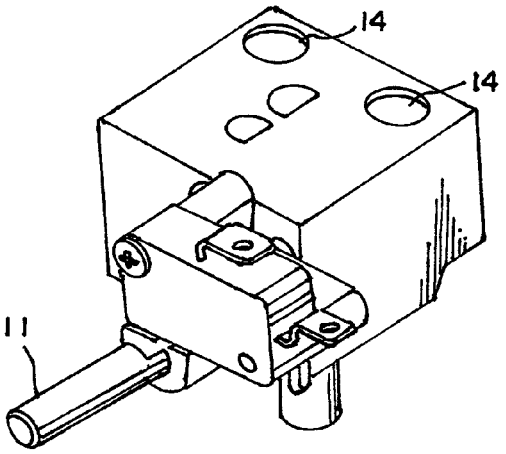
FIG. 3 shows a top perspective view of a dual outlet valve of the prior art construction.
Figure 4:
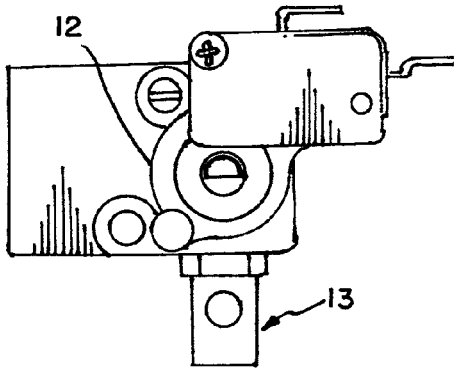
FIG. 4 shows a front plan view of the prior art dual valve shown in FIG. 3.
Figure 5:
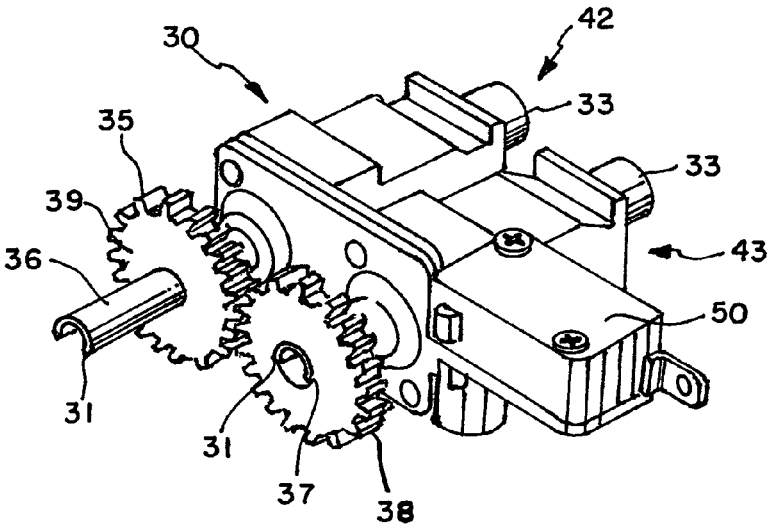
FIG. 5 shows a top perspective view of the presently preferred embodiment of the present invention.
Figure 6:
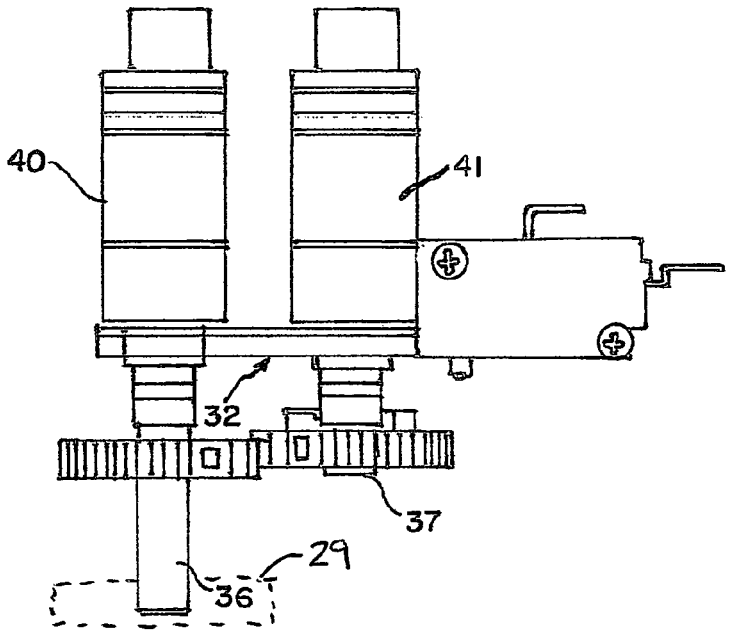
FIG. 6 shows a top plan view of the embodiment of FIG. 5.

FIG. 5 shows the dual valve 30 construction in accordance with a presently preferred embodiment of the present invention. Specifically, dual valve 30 has a dual control system 31 which includes a first control stem 36 for use with operably first valve portion which preferably connects to operating knob (not shown). A second control stem 37 may be shorter than the first shortened control stem 36. Second control stem 37 is preferably long enough to connect to second gear 38 which cooperates with first gear 39 (connected to first control stem 36) as will be explained in detail below.

The first control stem 36 preferably extends from a first valve portion 40 while second control stem 37 extends from the second valve portion 41. The first and second valve portions 40,41 preferably are connected with or joined with and/or share a single face plate 32 which not only joins the first and second valve portions 40,41, but also preferably connects the first and second valve portions 40,41 together and allows the control stems 36,37 to pass through.

Figure 7:
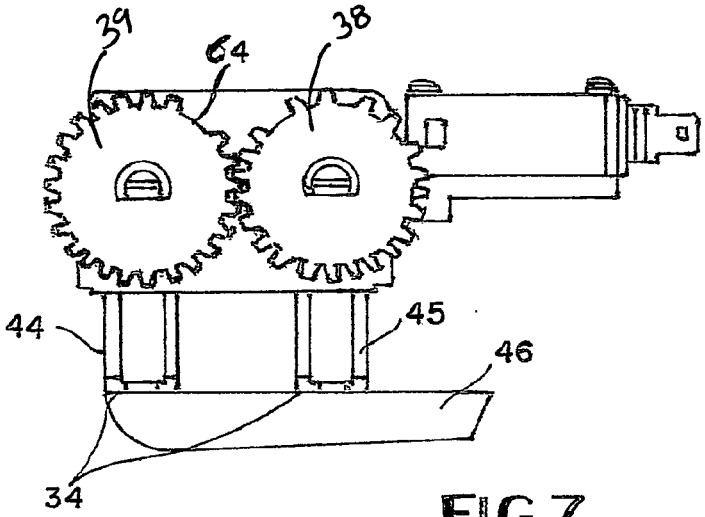
FIG. 7 shows a front plan view of the embodiments of FIGS. 5 and 6.
Figure 8:
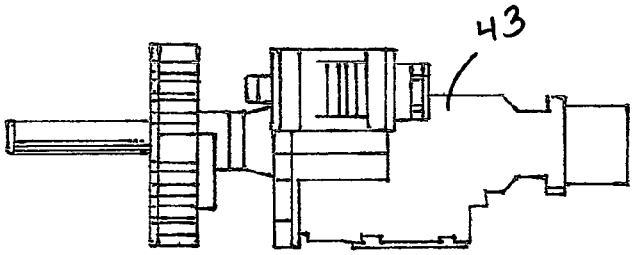
FIG. 8 shows a side plan view of the embodiments of FIG. 7.

The first control stem 36 is shown extending through the face plate 32 as is the second control stem 37. The first and second valve portions 40,41 are opposite the face plate 32 relative to first and second valve portions 40,41. First and second valve portions 40,41 provide the valve bodies and valve cones internal thereto. The first and second gears 39,38 can operably couple the rotation of the first control stem 36 to the second control stem 37 so that when the first control stem 36 is rotated, the second control stem 37 may be rotated as well. With gearing, the outlets 42,43 can be similarly or dissimilarly operated as desired. If there is a gearing ratio of 1-1, they may operate identically. Alternatively, there may also be offsets such as created by flats shown in FIG. 7 whereby turning of the first control stem 36 at least for a portion of an arc does not engage the second control stem 37.

The gearing ratio may also be different at different segments of the arcs of either first or second gears 39,38. Flats 64 may be provided on second gear 39 as desired as well. Inlets 34 such as first and second inlets 44,45 may or may not be connected together such as with a supply 46 as illustrated. Furthermore, in the outlets 42, 43 are preferably directed to two separate locations as dual outlet valves are normally directed to as it relates to gas ranges.

By providing the face plate and gearing combination shown and described herein, single valve portions 40,41 can be utilized in a unique dual valve 30 to take advantage of the manufacturing efficiency of the single valve constructions.

By changing the gearing ratios and/or flats 64, specifically along the first and/or second gears 39,38, the flame sequences of multi-function high end burners can be accommodated. As would be understood by those of ordinary skill in the art, particularly as it relates to flats 64 on either the first or second gears 39,38, and/or the gear ratio about the circumference of the gears 39,38 to accommodate a desired flame pattern. Switch 50 is useful to be energized at certain rotations to provide or allow current to flow to the ignition module for sparking.

As dual valves become more popular, the dual valve 30 of the presently preferred embodiments are believed to be a way to at least achieve operational efficiencies while providing dual valve capabilities.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

The invention claimed is:

1. A dual gas valve construction comprising:

a first valve portion having an inlet, an outlet and a first control stem for adjusting flow of gas from the inlet through the outlet to a first location;

a second valve portion similarly constructed as the first valve portion and having an inlet spaced from the inlet of the first valve portion, an outlet and a second control stem for adjusting flow of gas from the inlet through the outlet to a second location separated from the first location;

a mechanical linkage coupling the first control stem to the second control stem to form a dual valve, whereby for at least some rotation of the first control stem, the second control stem is moved through the mechanical linkage;

said first and second valve portion inlets are spaced apart and are in fluid communication with a common supply; and the outlets of the first and second valve portions are directed to separate rings of a gas burner.

2. The dual valve construction of claim 1 wherein the second control stem is shorter than the first control stem.

3. The dual valve construction of claim 1 wherein the first valve portion is located in a first housing and the second valve portion is located in a second housing separate from the first housing the mechanical linkage further comprises at least first and second gears, with said first gear connected to the first control stem and the second gear connected to the second control stem.

4. The dual valve construction of claim 3 wherein the first and second gears are not identical.

5. The dual valve construction of claim 3 wherein the first gear has a flat so that while turning the first control stem through an arc of the flat, the second gear does not turn.

6. The dual valve construction of claim 3 wherein for at least a portion of the first and second gears, there are different gear ratios.

7. The dual valve construction of claim 1 further comprising an ignition switch connected to the first and second valve portions.

8. The dual valve construction of claim 1 further comprising an operating knob connected to the first control stem.

9. The dual valve construction of claim 1 further comprising a face plate connecting the first and second valve portions while allowing rotation of the first and second control stems.

10. The dual valve construction of claim 9 wherein the mechanical linkage further comprises at least first and second gears, with said first gear connected to the first control stem and the second gear connected to the second control stem with the first and second gears being on a first side of the face plate and the inlet and outlet of the first and second valve portions being on an opposite side of the face plate from the first and second gears.

11. The dual valve construction of claim 1 wherein the first and second control stems rotate through a range of motion from an off position to a full gas flow position.

12. A dual gas valve construction comprising:

a first valve portion having an inlet, an outlet and a first control stem for adjusting flow of gas from the inlet through the outlet;

a second valve portion similarly constructed as the first valve portion having an inlet spaced from the inlet of the first valve, an outlet and a second control stem for adjusting flow of gas from the inlet through the outlet to a location physically separated from the outlet of the first valve;

at least first and second gears coupling the first control stem to the second control stem, whereby for at least some rotation of the first control stem, the second control stem is moved; and said inlets of the first and second valve portions are spaced apart and are in fluid communication with a common supply and said outlets of first and second valve portions are directed to separate rings of a gas burner.

13. The dual valve construction of claim 12 wherein the second control stem is shorter than the first control stem and the first and second valve portions are spaced by separated first and second valve housings, respectively.

14. The dual valve construction of claim 12 wherein the first gear has a flat so that while turning the first control stem through an arc of the flat, the second gear does not turn.

15. The dual valve construction of claim 12 wherein for at least a portion of the first and second gears, there are different gear ratios.

16. The dual valve construction of claim 12 further comprising an ignition switch connected to the first and second valve portions.

17. The dual valve construction of claim 12 further comprising an operating knob connected to the first control stem.

18. The dual valve construction of claim 12 further comprising a face plate connecting the first and second valve portions while allowing rotation of the first and second control stems.

19. The dual valve construction of claim 12 wherein said first gear is connected to the first control stem and the second gear connected to the second control stem with the first and second gears being on a first side of a face plate and the inlet and outlet of the first and second valve portions being on an opposite side of the face plate from the first and second gears.

20. The dual valve construction of claim 12 wherein the first and second control stems rotate through a range of motion from an off position to a full gas flow position.

* * * * *